US009779580B2

(12) United States Patent
Jones

(10) Patent No.: US 9,779,580 B2
(45) Date of Patent: Oct. 3, 2017

(54) LIVE CASINO TABLE GAME WITH LOCAL AND REMOTE BETTING TERMINALS

(71) Applicant: Mark Hamilton Jones and Sheryle Lynn Jones Family Trust dated November 7, 2013, Gardnerville, NV (US)

(72) Inventor: Mark H. Jones, Genoa, NV (US)

(73) Assignee: Mark Hamilton Jones and Sheryl Lynn Jones Trust, Gardnerville, NV (US), dated November 7, 2013

( * ) Notice: Subject to any disclaimer, the term of this patent is extended or adjusted under 35 U.S.C. 154(b) by 0 days.

(21) Appl. No.: 13/789,154

(22) Filed: Mar. 7, 2013

(65) Prior Publication Data

US 2014/0256392 A1 Sep. 11, 2014

(51) Int. Cl.
*A63F 1/00* (2006.01)
*G07F 17/32* (2006.01)

(52) U.S. Cl.
CPC ..... *G07F 17/322* (2013.01)

(58) Field of Classification Search
CPC .... A63F 1/06; A63F 1/067; A63F 1/12; A63F 2001/02; G07F 17/322
USPC ..... 463/12; 273/292, 293, 309, 149 R
See application file for complete search history.

(56) References Cited

U.S. PATENT DOCUMENTS

2003/0064798 A1* 4/2003 Grauzer et al. ..... 463/29
2006/0284376 A1* 12/2006 Snow ..... A63F 3/00157 273/292
2007/0126186 A1* 6/2007 Crawford et al. ..... 273/459
2007/0241497 A1* 10/2007 Soltys et al. ..... 273/149 R
2007/0243927 A1* 10/2007 Soltys ..... 463/25
2007/0273094 A1* 11/2007 Fleckenstein ..... 273/149 P
2009/0017888 A1* 1/2009 Kuhn et al. ..... 463/13
2009/0243213 A1* 10/2009 Pececnik et al. ..... 273/149 R
2010/0062845 A1* 3/2010 Wadds et al. ..... 463/30

* cited by examiner

*Primary Examiner* — Allen Chan
(74) *Attorney, Agent, or Firm* — John S. Artz; Dickinson Wright PLLC

(57) ABSTRACT

A table game system having a table surface and a shuffling device for holding a set of cards. Each of the cards in the set of cards bears indicia relevant to determining an outcome of a game of chance. A computer is in communication with the set of cards for determining the indicia of each of the plurality of cards. The table system has a plurality of local terminals in communication with a computer and associated with the table surface for receiving wagers adjacent the table surface. A plurality of remote terminals associated with the table surface for receiving a wager from a player located remotely from the table surface. The plurality of remote terminals are each in communication with the computer. The computer is configured to resolve any wagers from the plurality of local terminals and the plurality of remote terminals automatically based on the outcome of the game of chance.

18 Claims, 5 Drawing Sheets

LIVE CASINO TABLE GAME WITH LOCAL AND REMOTE BETTING TERMINALS

CROSS-REFERENCE TO RELATED APPLICATIONS

The present application is a continuation-in-part of U.S. patent application Ser. No. 13/691,290, entitled "Turbo Card Table Game and RFID Card Identifier", filed on Nov. 30, 2012, which claims priority to U.S. Provisional Patent Application Ser. No. 61/565,057, entitled "Turbo Card Table Game and RFID Card and Tip Button", filed on Nov. 30, 2011; and is also a continuation-in-part of U.S. patent application Ser. No. 13/280,691, entitled "Rotary Card Shuffling Machine", filed on Oct. 25, 2011, which is a continuation-in-part of U.S. patent application Ser. No. 12/912,276, entitled "Casino Card Game" filed Oct. 26, 2010, which claims priority to U.S. Provisional Patent Application Ser. No. 61/255,128, entitled "Mystery Card Bonus", filed Oct. 27, 2009 and U.S. Provisional Patent Application No. 61/408,270, entitled "Vertical Card Shuffling Machine", filed Oct. 29, 2010, the entire disclosures of which are hereby incorporated by reference as though set forth fully herein.

TECHNICAL FIELD

The present disclosure relates generally to a table game system that allows for increased player flexibility and enjoyment. More particularly, the present disclosure relates to a table game system that employs a live dealer and allows for play from both local and remote locations.

BACKGROUND OF THE INVENTION

Games of chance are well known activities whose outcomes are strongly influenced by randomizing devices, and upon which contestants may wager money as they forecast outcomes. Common randomizing devices include dice, spinning tops, playing cards, roulette wheels, prize wheels, and numbered balls drawn from containers. Games of chance have been played throughout all of human history and are considered to be a popular pastime by many. Players of games of chance are attracted to new and exciting methods of game play as well as new and exciting randomizing devices. For this reason, the gaming industry is continuously developing new games and new randomizing devices to maintain player interest and attract new players.

Games of chance that include money wagers are typically regulated by governing authorities. These governing authorities enforce laws and regulations that are enacted to curtail certain kinds of games as well as certain kinds of randomizing devices. For example, in some jurisdictions, the use of dice or roulette wheels to resolve a game outcome, i.e., as the randomizing device, have been curtailed while other randomizing devices such as playing cards are permitted. More frequently, randomizing devices that use playing cards have been utilized as they enjoy fewer restrictions in games played for money than dice and roulette wheel randomizing devices.

Additionally, table games managers are continually looking for ways to improve the efficiency of their Dealers in connection with all games, thereby reducing labor costs. Unlike slot managers, who do not have to worry about employee mistakes that cost the casino money (known as bleed), table games managers face these issues on a daily basis. As casinos gets busier and the tables get fuller, the decisions per hour can decrease dramatically and the potential for bleed increases significantly. The advent of iTable games, which employ live dealers, has provided some efficiency by eliminating all chips and resolving all wagers electronically.

However, there is a desire within the gaming industry to develop new and interesting methods of game play that provide increased player flexibility and enjoyment and which minimize the opportunity for bleed.

SUMMARY OF THE INVENTION

It is therefore an aspect of the present disclosure to provide a table game system that provides increased player involvement and interaction.

It is another aspect of the present disclosure to provide a table game system that can reduce labor costs associated with the operation of the game.

It is still another aspect of the present disclosure to provide a table game system that can minimize dealer errors and bleed.

It is yet another aspect of the present disclosure to provide a table game system that can increase security measures.

It is a further aspect of the present disclosure to provide a table game system that can provide increased player entertainment and enjoyment.

It is still a further aspect of the present disclosure to provide a table game system that allows players to play multiple games simultaneously.

In accordance with the above and the other aspects of the present disclosure, an improved table game system is provided. The table game system includes a table surface with a card shuffling machine configured to hold a set of cards to be dealt by a dealer. Each of the cards in the set has indicia relevant to determining an outcome of a game of chance. Each of one or more card readers is configured to read the indicia of the cards removed from the shuffling machine and then transmit that information to a computer configured to operate in accordance with the rules of the game of chance being played. The system includes a plurality of local terminals that are associated with the table surface and configured to receive a wager from a player adjacent the table surface. The plurality of local terminals are also in communication with the computer. The system also includes a plurality of remote terminals that are associated with the table surface and configured to receive a wager from a player located remotely from the table surface. The plurality of remote player terminals are also in communication with the computer. The computer is configured to resolve any wagers from the plurality of local player terminals and the plurality of remote player terminals automatically based on the outcome of the game of chance as determined from the read indicia of the cards.

BRIEF DESCRIPTION OF THE DRAWINGS

These and other features and aspects of the present invention will become more readily appreciated when considered in connection with the following detailed description and appended drawings wherein.

DETAILED DESCRIPTION OF THE PREFERRED EMBODIMENT

Figure 1:
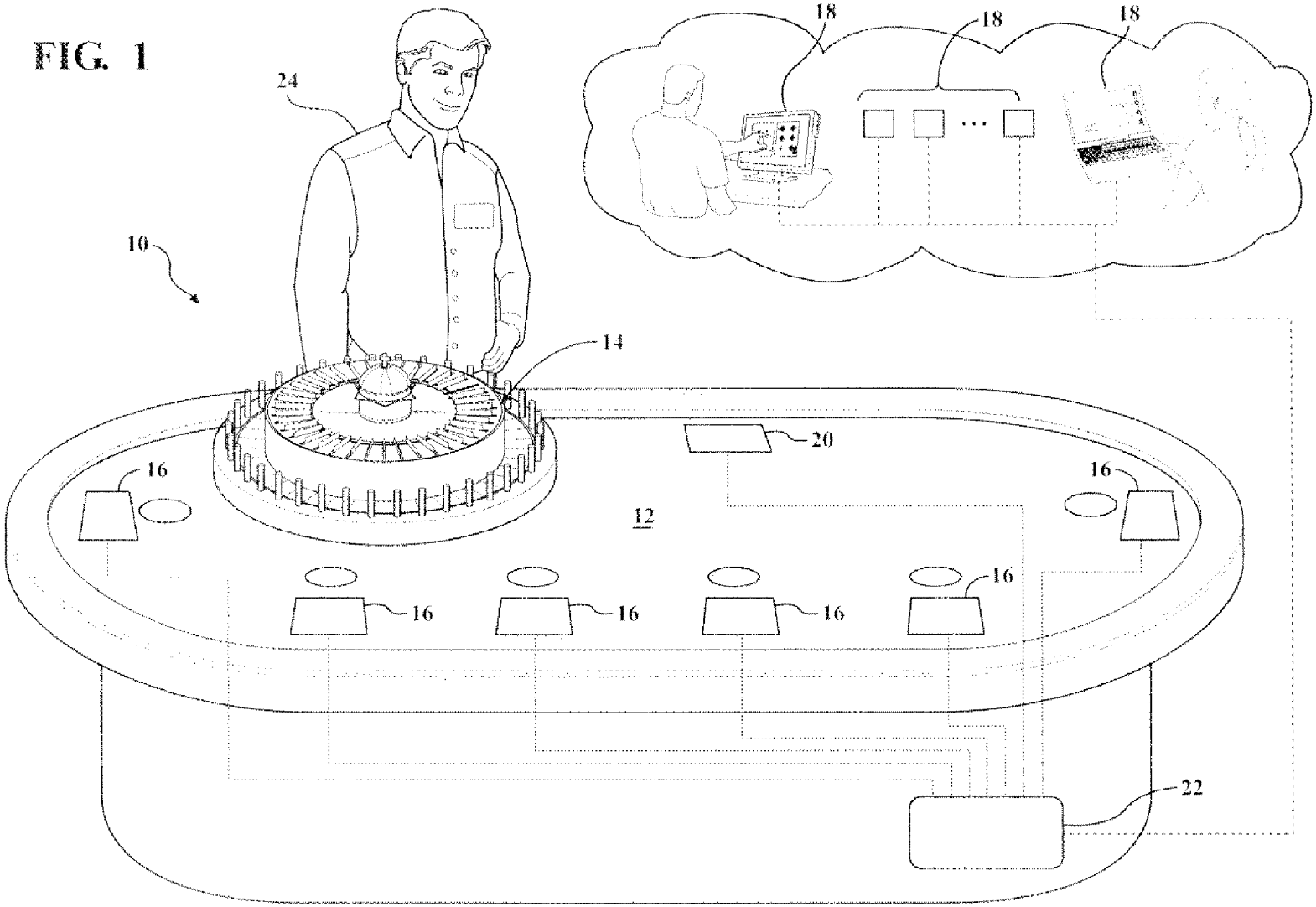
FIG. 1 is a perspective view of a table game system having a plurality of local and remote terminals according to an aspect of the disclosure.
Figure 2:
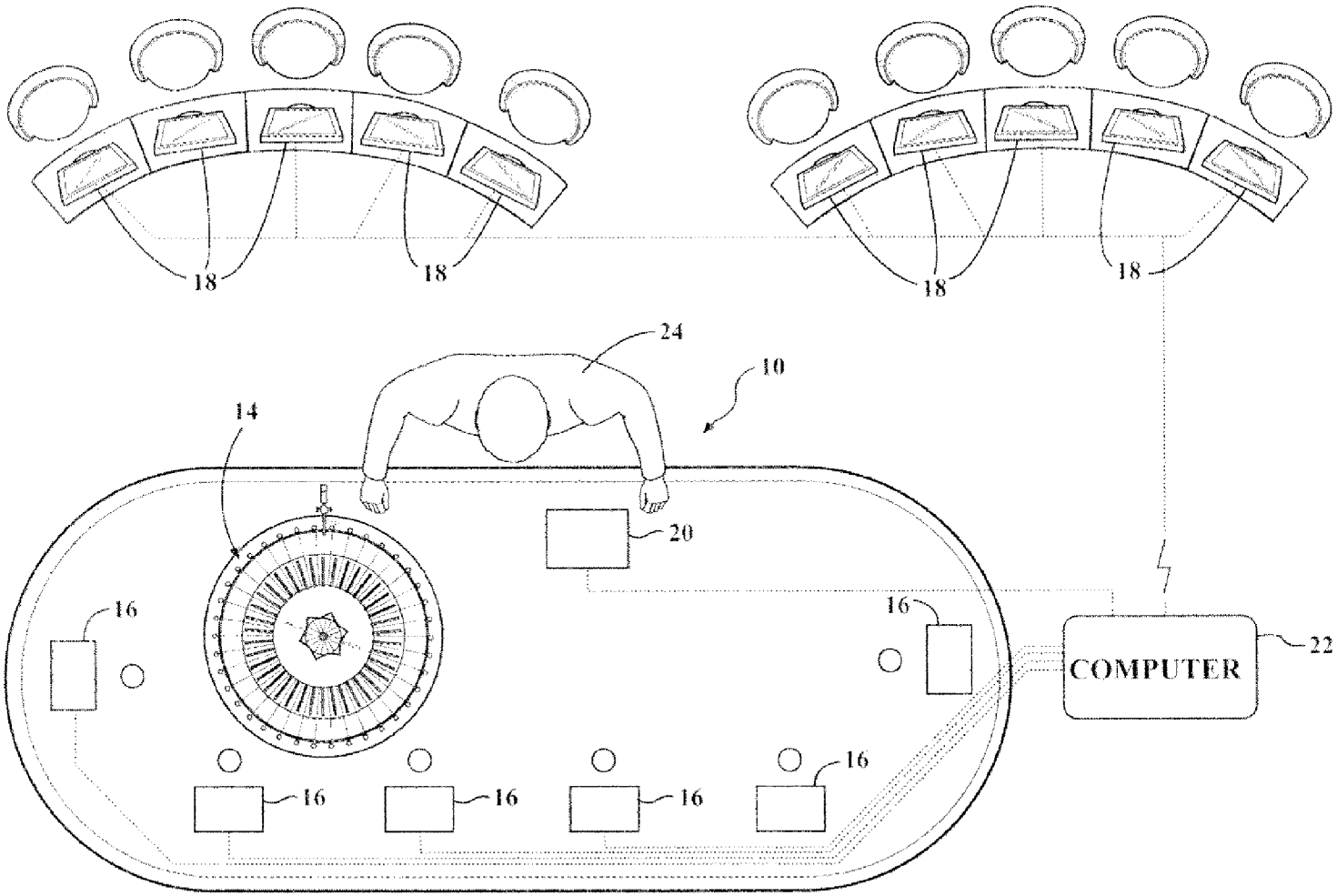
FIG. 2 is a top schematic view of the table game system having a plurality of local and remote terminals of FIG. 1.

The present disclosure relates to a table game system 10 that allows players to wager on a game of chance. As shown in FIGS. 1 and 2, according to an aspect, the table game system 10 can include a table surface 12, a card shuffling machine 14, a plurality of local terminals 16, a plurality of remote terminals 18, a card reader 20 and a computer 22 with a processor. According to another aspect, the table game system 10 can include a live dealer 24 for dealing cards from the shuffling machine 14 according to the rules of the game of chance being played. The table game system 10 may be configured to play any game of chance, including craps, roulette, blackjack, poker or baccarat. It will be appreciated that the table game system 10 could be configured to play other games. It will also be appreciated that the table game system 10 can have more or less or different components than those described above.

According to an aspect, the table surface 12 can include a layout relevant to the game of chance being played. For example, the table surface 12 may have a plurality of player locations marked on the table where cards would be placed for that player, such as occurs in the game of blackjack. Similar layouts can exist for other games of chance. Additionally, the layout can include other features relevant to the game of chance being played. According to another aspect, a complete layout is not necessary as the table game system 10 does not utilize real chips, as is discussed in more detail below. Alternatively, a complete layout may be included for player convenience and comfort.

Figure 3:
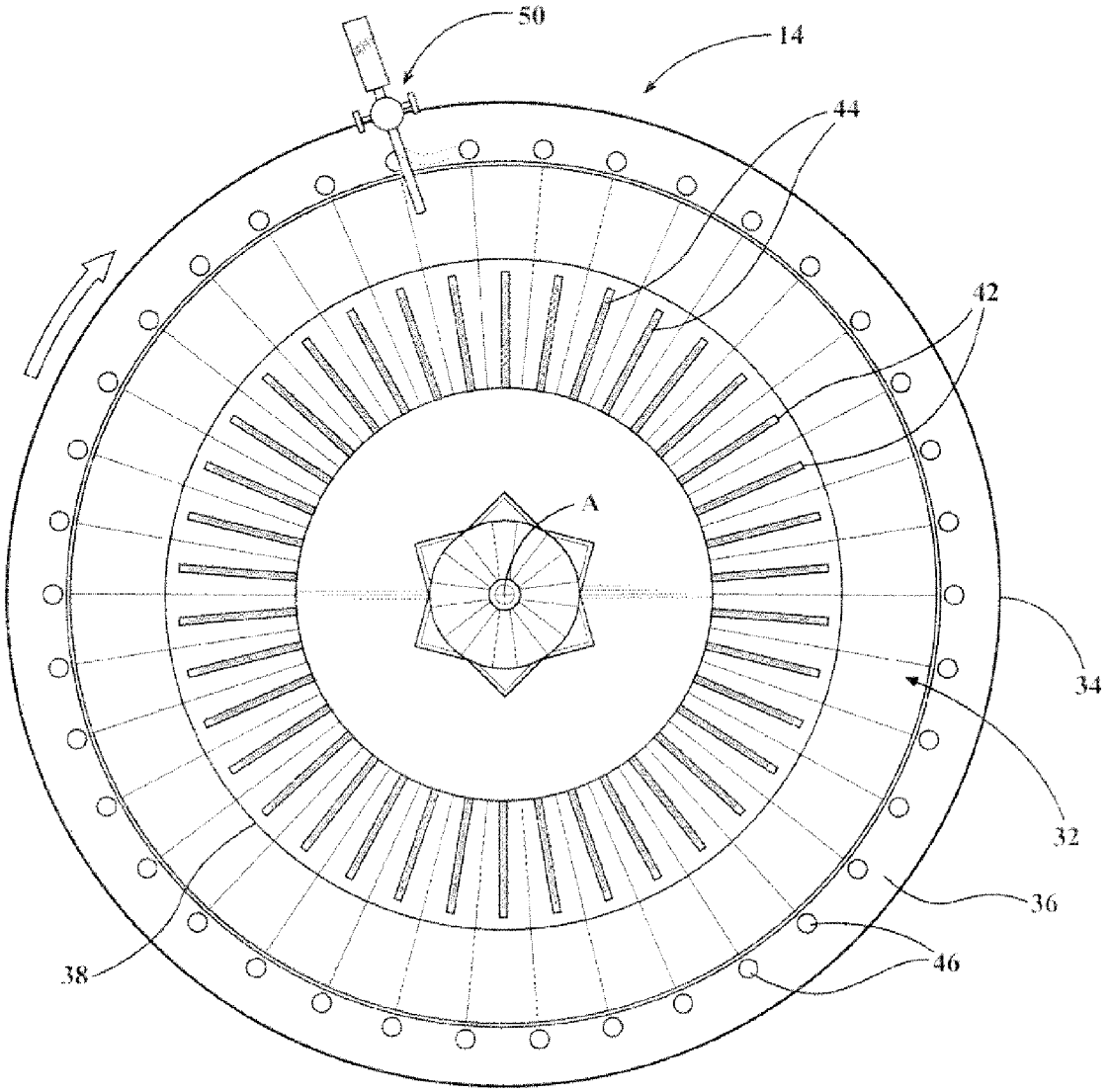
FIG. 3 is a top plan view of a shuffling machine in accordance with an aspect of the disclosure.

According to an aspect, a card shuffling machine 14 may be disposed on the table surface 12 to allow a dealer 24 to remove physical cards therefrom and place them on the table surface and/or deal them to players according to the rules of the game being played. The card shuffling machine 14 may have a variety of different configurations. Pursuant to one aspect, the card shuffling machine 14 may consist of a shoe, such as that typically used in blackjack table games. The card shuffling machine 14 can be configured to hold a single deck of cards or multiple decks. According to another aspect, the card shuffling machine 14 may be configured as a wheel, as is described briefly in connection with FIG. 3 and as described in detail in Applicant's co-pending U.S. patent application Ser. No. 13/691,290, entitled "Turbo Card Table Game and RFID Card Identifier", which is hereby incorporated by reference as though set forth fully herein.

According to an aspect, the card shuffling machine 14 can randomly select a single card from among a set of cards and may include a stationary base 30. The base 30 can include a turntable 32 that is movably supported thereon for free rotation within a generally horizontal plane about a central vertical axis A. The turntable 32 can have a generally circular outer periphery 34, a circumscribing outer rim section 36 and an elevated stage section 38. The card shuffling machine 14 can include a plurality of trays 42 that are uniformly spaced apart about the turntable 32. The number of trays preferably corresponds to the number of cards required for the game of chance to be played. In one example, the defined plurality of trays 42 may consist of exactly thirty-eight trays for holding thirty-eight distinct cards 44 which bear indicia relevant to the game of roulette. It will be appreciated that the number of cards and their indicia may vary depending upon the game of chance to be played. According to an aspect, the card shuffling machine 14 and the cards 44 being held therein can be configured for playing craps, blackjack, war, baccarat, poker or a variety of other games of chance. Additionally, the card shuffling machine 14 may be configured to hold multiple complete sets of cards involved in the game of chance.

The trays 42 may comprise narrow slots arranged along radials extending away from the central axis A and which are sized, shaped and oriented so as to hold a single playing card 44 in a vertically upstanding orientation. It will be appreciated that the configuration of the slots may vary. Also, the cards can be retained in a variety of suitable ways. The cards 44 may be dimensionally similar to those used for playing card games like poker, blackjack and the like. Instead of the traditional rectangular configuration, the cards 44 may be shaped in other interesting or effective geometries. In accordance with one example, a set of cards 44 is equal in number to the defined plurality of trays 42.

As shown, the rim section 36 of the turntable 32 may be provided with a plurality of dividers 46, which are equal in number to the defined plurality of trays 42. Thus, in the exemplary embodiment where thirty-eight trays are provided, the number of dividers 46 also number thirty-eight. The dividers 46, like the trays 42, are also spaced one from another in equal circumferentially-spaced increments about the central axis A. In this manner, the space or gap between each divider 46 may be exclusively associated with one specific tray 42 such that the card 44 within that tray may be selected. A pointer or other structure may be employed to identify the selected card when the turntable 32 comes to rest. It will be appreciated that other arrangements of the turntable 32 may be employed.

According to an aspect, a detent 50 may be fixed relative to the base 30 to operatively interact with the dividers 46. The detent 50 can function to apply a pulsating resistance to the free rotation of the turntable 32 and thereby progressively slow the turntable 32 to a stopped condition relative to the base 30. It will also be appreciated that instead of a detent, the card shuffling machine 14 can be controlled electronically to start and stop rotation of the turntable 32, such as upon the pressing of a button by the dealer. It will be appreciated that the shuffling machine 14 may employ a variety of different configurations. Instead of a card shuffling machine 14, a variety of other suitable random number generators could be employed, such as a ball, blower or dice.

For games of chance that may require multiple cards to be drawn to determine an outcome, a card shuffling machine 14 that can select multiple cards at a time can be utilized. Such an exemplary card shuffling machine is disclosed in Applicant's co-pending U.S. patent application Ser. No. 13/741,012, entitled "Multi-Tier Card Shuffler", filed on Jan. 14, 2013, the disclosure of which is hereby incorporated by reference as though set forth fully herein.

According to an aspect, the live dealer 24 may be utilized at the table surface 12 to remove the cards 44 from the shuffling machine 14 and deal them to the players or place them on the table surface 12, depending upon the rules of the game being played. The system 10 may also include a dealer terminal that allows the dealer to control game play, such as when wagering is available or the period for wagering has closed. The dealer terminal may also allow the dealer 24 to confirm the outcome of the game of chance based on the information obtained by the card reader 20, as is discussed in more detail below.

It will be appreciated that the table surface 12 could utilize multiple shuffling machines 14 to allow more than one game to be played at a single table surface. According to an aspect, the card shuffling machine 14 could be configured to play the same game or different games. Such a system is disclosed in Applicant's co-pending U.S. patent application Ser. No. 13/691,290, entitled "Turbo Card Table Game and RFID Card Identifier", which is hereby incorporated by reference. Such a system allows more hands to be played in a shorter period of time and allows for more enjoyment to the players and more possible return for the casino.

According to a further aspect, the table surface 12 may be located in the pit of a casino and employ a live dealer 24. According to a still further aspect, the table surface 12 may include a plurality of player positions with associated local terminals 16. The local terminals 16 are preferably electronic terminals that are integrated into the table surface 12. However, the local terminals 16 could be portable such that the player could take them with them when they leave. An exemplary local terminal could include an iPhone, iPad or other mobile device. Alternatively, other devices may be employed. The local terminals 16 can be spaced around the table to allow players to sit and participate in the game of chance at the table surface 12. According to an aspect, the local terminals 16 are in communication with a computer 22. The computer 22 can include a digital processor with pre-programmed software for operating the game of chance. According to an aspect, the local terminals 16 may include touch screen displays that allow players to place wagers such as are commonly sued for video poker games. Based on the outcome of the game of chance, the computer 22 can automatically resolve wagers at each of the local terminals 16 automatically. The local terminals 16 may include a credit card reader that allows a player to insert a card in order to obtain cash to play the game of chance. According to another aspect, a cash slot may also be included to allow a player to insert cash into the terminal to play the game. According to a still further aspect, a player could input information electronically on the touch screen to obtain credit to play the game. Moreover, the local terminals 16 can include a ticket dispenser to issue a ticket when a player is done playing to allow them to redeem the ticket for cash. According to another aspect, the local terminals 14 may be configured to display the identity of cards dealt by the dealer as well as the players' cards. The electronic local terminals can eliminate the need for chips as well as the need for the dealer to resolve wagers. This minimizes the opportunity for bleed and also allows the game to be played quicker such that more hands can played in a shorter period of time.

According to another aspect, the system 10 can also include a plurality of remote terminals 18. The plurality of remote terminals 18 can be located in various locations on the casino floor away from the table surface. According to a further aspect, the remote terminals 18 can be disposed at other remote locations, such as at a player's home or a variety of other suitable locations so that players can play the game of chance at the table surface 12 with the live dealer or remotely away from the table surface 12. The plurality of remote terminals 18 may each include a touch screen display to allow players to interact with the terminal. The terminals are also in communication with the computer 22. According to another aspect, players can obtain money to play the game in the same fashion as with the local terminals 16. According to a still further aspect, the terminals 18 can display the identity of the cards being dealt by the dealer 24. Additionally, the computer 22 can be configured to deal cards to the players at the remote terminals 18 as required by the rules of the game. Alternatively, the computer 22 can be configured to deal cards electronically to the remote terminals 18. The cards dealt to players at the remote terminals 18 could correspond to cards drawn by the live dealer or could correspond to cards drawn electronically.

According to a further aspect, the table game system 10 can include a card reader 20 that allows cards that are selected by or dealt from the shuffling machine 14 to be read. For example, if cards are dealt from the shuffling machine 14 such as for the game of blackjack, the card reader 20 can determine the indicia of each of the cards being dealt and the location to where the cards are dealt. The card reader 20 may be in communication with the computer 22 such that this information can be transmitted to the computer 22 so the outcome of the game of chance can be determined automatically as the cards are dealt. This minimizes the potential for dealer error, while still providing players with the enjoyment associated with a live dealer and real cards. The utilization of a live dealer provides an element of trust for many players. It will be appreciated that a plurality of card readers 20 may be employed at the table surface 12, including one adjacent each player location or position as well as associated with the dealer position. According to an aspect, if a single card reader 20 on the table surface 12 is employed, the dealer 24 may cause the cards to be read as the cards are dealt. In accordance with still another aspect, a card reader 20 could be incorporated into the shuffling machine 12 such that the identity of each of the cards can be determined while the cards are in the shuffling machine 14. As used herein, the term "reader" refers to any device that can obtain information about the indicia of the card.

According to one aspect, the card reader 20 may be an RFID card reader. Alternatively, other suitable electronic scanning devices may be used to input the cards removed from the shuffling machine 12 into the computer 22, which may be configured as a suitably programmed electronic game server capable of executing the game being played. According to another aspect, the card reader 20 may be in the form of a laser scanner that is capable of recognizing the machine readable indicia on the card 44.

Pursuant to another aspect, one or more display screens may also be employed adjacent the table surface 12 to virtually display the table surface 12 and the cards dealt based on the information determined from the reader 20 so it can be easily seen. Also, the results of the game and/or other information may be displayed on the display screen, which may be visible to the players as well as other viewers not playing the game.

Figure 4:
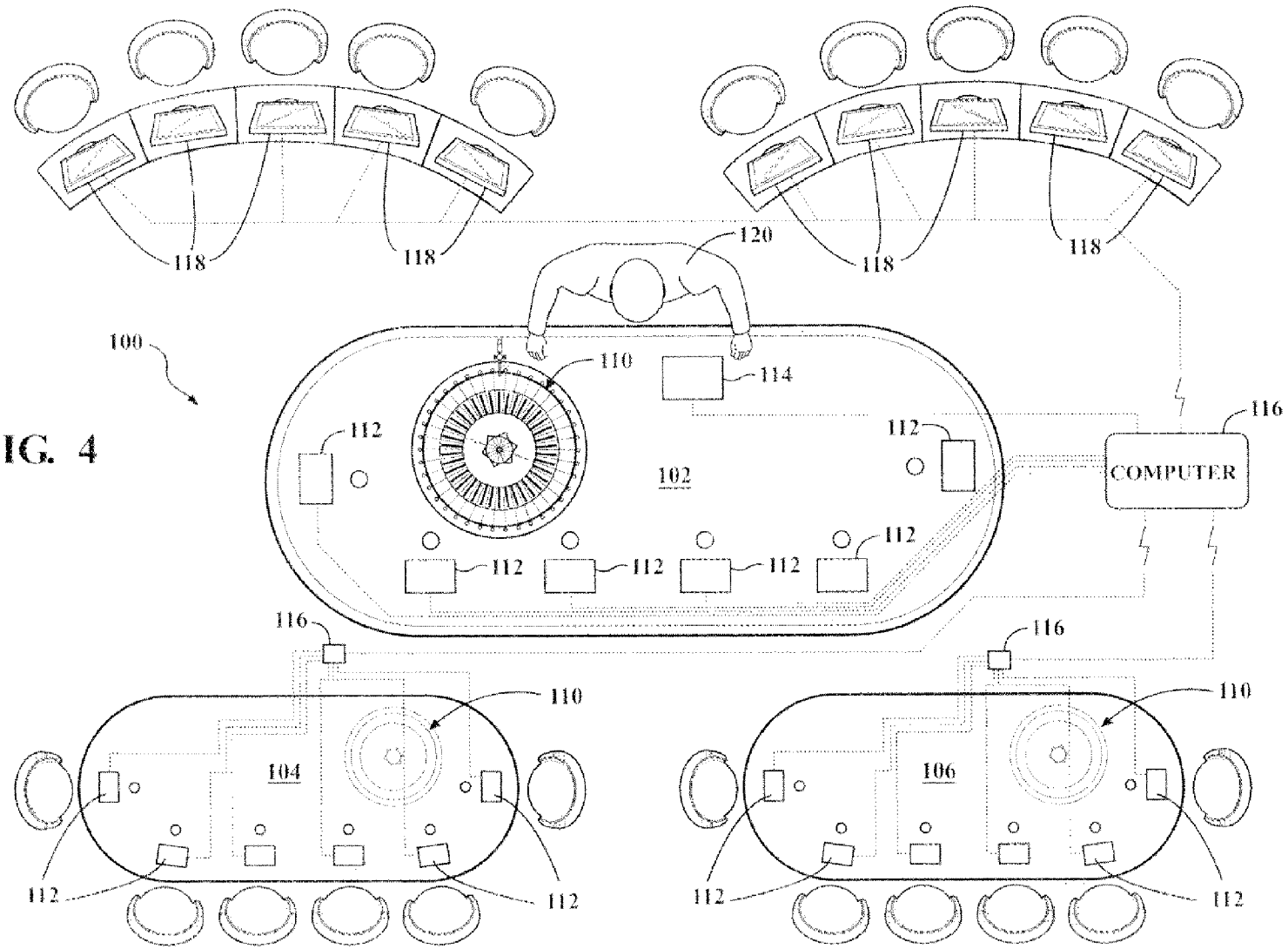
FIG. 4 is schematic view of a table game system, including a plurality of discrete table games with local and remote terminals in accordance with another aspect of the disclosure.

FIG. 4 illustrates another aspect of the present disclosure where the system allows players to participate in multiple different games of chance simultaneously. As shown, the system 100 includes multiple table surfaces 102, 104, 106. Each table surface 102, 104, 106 can include a card shuffling machine 110, a plurality of local terminals 112, a card reader 114 and an associated computer 116 with digital processor. According to an aspect, a single computer 116 may be associated with each of the table surfaces 102, 104, 106. Alternatively, each table surface 102, 104, 106 may have its own computer 116 with each of the computers being in communication with each other and a server. The computer 116 may be a local server or may be a cloud computer.

As with the aspect of FIGS. 1 and 2, the table surfaces 102, 104, 106 can each include a live dealer 120 which takes cards from the shuffling machine 110 and deals them to the players or places them on the table surface 102, 104, 106 depending upon the rules of the game being played. The local terminals 112 at each table surface 102, 104, 106 may have the same configuration as the local terminals 16. Each table surface 102, 104, 106 can have a card reader 114 associated therewith for determining the identity of the cards removed from the shuffling machine 110 and transmitting it to the computer 116. The card reader 114 operates similarly to the card reader 20 discussed above, and can be configured similarly.

According to an aspect, the local terminals 112 associated with the table surface 102 allow the players to wager on the outcome of the game of chance being played at that table surface. According to another aspect, the local terminals 112 at the table surface 102 could be configured to allow players to wager on the outcome of the games of chance being played at the other table surfaces 104, 106. According to a related aspect, the local terminals 112 could be configured to display multiple games at the same time from various table surfaces 102, 104, 106. According to an aspect, the table surfaces 102, 104, 106 can each be configured to play the same game of chance. Alternatively, the table surfaces 102, 104, 106 could each be configured to play a different game of chance. It will be appreciated that the number of table surfaces that are part of the system 100 is not limited and could be more or less than those shown.

According to an aspect, the computer 116 is in communication with a plurality of remote terminals 118 such that the remote terminals allow players to play a game of chance remotely. According to a further aspect, the remote terminals 118 can each be configured to play the games of chance at each of the table surfaces 102, 104, 106. The remote terminals 118 may have the same configuration as the terminals 18 discussed above and can operate similarly. Pursuant to an aspect, a player at a remote terminal 118 could play games on multiple table surfaces 102, 104, 106 at the same time. Alternatively, a player at a remote terminal 118 could switch back and forth between games at different table surfaces 102, 104, 106 depending upon the player's desire, for example, if the player likes a particular dealer. According to an aspect, the players do not need to alert the dealer/operator which game they are playing at any given moment, as the electronic terminals 112, 118 keep track of this information—including the resolution of wagers placed.

Figure 5:
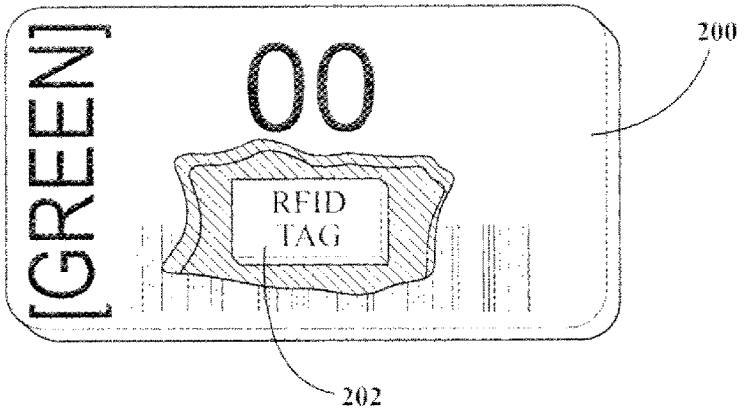
FIG. 5 is a schematic illustration of an exemplary playing card in accordance with an aspect of the disclosure.

FIG. 5 illustrates a card 200 bearing indicia related to a decision for a game of chance. This exemplary card 200 reflects one of the numbers or results associated with the game of roulette. As shown, the card 200 bears indicia for the number "00" and the color green. According to an aspect, the card 200 also includes an RFID tag 202 associated therewith. According to an aspect, the RFID tag can be embedded in the card 200. As will be understood, the RFID tag 202 contains the information about the card indicia, i.e., color and number thereon.

Figure 6:
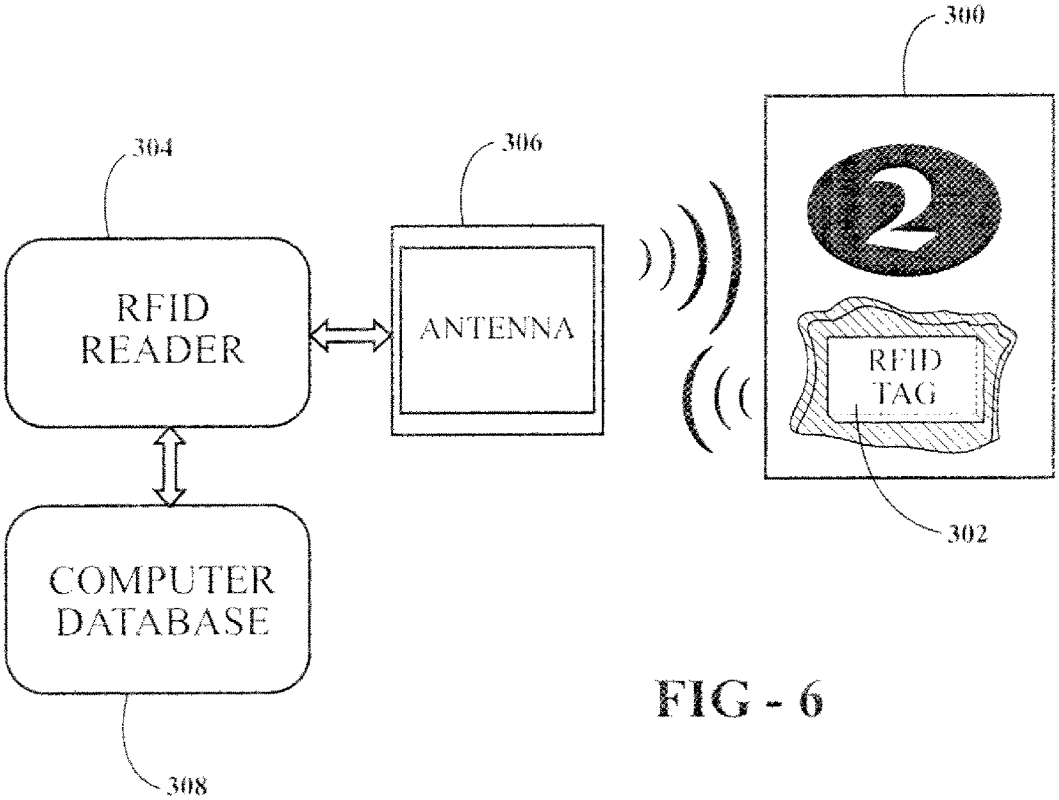
FIG. 6 is a schematic diagram illustrating a method for identifying a specific playing card in accordance with an aspect of the disclosure.

FIG. 6 schematically illustrates the steps of reading a card 300 according to one aspect of the disclosure. As shown, the card 300 bears indicia related to the game of roulette, specifically the number 2 and the color black. A RFID tag 302 associated therewith may have information stored thereon. When the card 300 is brought into proximity with an RFID card reader 304, which includes a wireless antenna 306 to communicate with the RFID tag 302, the RFID card reader 304 reads the information about the card that is stored on the RFID tag 302. The information is then transmitted to a computer database 308 so that it can be utilized to settle wagers and display it on the monitors and terminals. As discussed above, the indicia of the cards may be read by a variety of other suitable methods.

According to an aspect, the cards may be constructed of a hard plastic. The back sides of the cards can include the game logo on the back of the card. The card shuffling machine may be configured to hold the RFID-enabled hard plastic custom cards. According to an aspect, several advantages can be achieved using these custom cards. First, they provide a huge increase in game security as the cards can be memorized by the computer system one at a time when they are placed into the shuffler. If an unauthorized person tries to insert a card that was not one originally placed in the shuffler, it will not be read therefore it will not communicate with the game server which settles wagers at the terminals. This can eliminate one cheating threat. By using these custom cards, the system can also eliminate the need for the operator to manually input the decision number. Instead, the operator can remove the card from the shuffler and lay it on the associated reader. The pre-programmed software running on the linked computer server can display the card indicia which allows the operator to confirm that these match before proceeding. The information can then be posted on the game terminal and public display and all wagers are settled based on this confirmation. The software will not allow the operator to enter the wrong number. This also eliminates Dealer/Customer collusion which can be a major problem on live table games.

In a standard dealer dealt game, as more players join the game, the casino's decisions per hour decreases as it takes the dealer longer to make the payouts. A full standard Roulette game will play about 39 hands per hour with an experienced dealer. According to an aspect, the disclosed system using the local terminals and no chips can generate on average 120 decisions per hour no matter how many players join into the game. This can provide a major increase in potential revenue to the casino. According to an aspect, the disclosed system can accommodate a large number of individual player terminals. By adding a router which provides unlimited connectivity, the number is significantly higher. The current system also gives the casino unlimited flexibility in floor configuration.

The system allows the casino the ability to place wagering terminals in multiple locations in the casino utilizing the same single operator by broadcasting the game using live feeds from the local terminals. When the operator touches the "no more bets" option on the dealer terminal screen, a live feed will be broadcasted to the terminals and public displays so that the players can view the dealer removing the card and seeing the number drawn or the cards dealt. This will provide the players with a warm and fuzzy feeling that all is on the up and up.

The system can provide significant advantages in that it can give the casino the opportunity to eliminate dealer training, surveillance training, dealer error, casino bleed and reduced supervision while increasing decisions per hour not seen before and at the same time passing on benefits to the players by allowing them to stretch their bankroll by offering smaller minimums and longer potential time at the table.

In operation, according to an aspect, the system 100 allows a plurality of computerized terminals 112, 118 to be operated simultaneously, and each communicate directly, or indirectly, with a digital processor. At the start of each game, each player wagers according to the game rules of the game of chance they are playing and makes a forecast on the game outcome. According to an aspect, a dealer places the turntable 32 into rotation and, at the appropriate time, engages the detent 50 to progressively slow the turntable 32 to a stop condition. Thereupon, a pointer can identify one tray 42, from which the associated card 44 is withdrawn, i.e., selected. The dealer can then pass the one selected card 44 in view of the card reader 42, causing the digital processor to recognize the game decision and resolve each individual player's game via their computerized terminals. In situations where wagers are resolved at each game terminal, as in ticket in-ticket out (TITO) and other such systems, there is no requirement for the dealer or game operator to handle chips, tokens or cheques. The dealer may also be provided with a graphical user interface (GUI) to be of the touch screen variety. Through such a GUI, the dealer may effectively administer the game and the wagering process.

According to an aspect, electronic posting of the selected card 44 can flow through both a reader board and game processing software to add speed, certainty and enjoyment to the game play. Of course, other card reading formats and card recognition techniques may be employed with, or without, any visible markings on the cards 44. Alternatively, a dealer can manually input the card value, i.e., indicia, manually to the digital processor via the GUI.

The foregoing invention has been described in accordance with the relevant legal standards, thus the description is exemplary rather than limiting in nature. Variations and modifications to the disclosed embodiment may become apparent to those skilled in the art and fall within the scope of the invention. Accordingly the scope of legal protection afforded this invention can only be determined by studying the following claims.

What is claimed is:

1. A table game system, comprising:

a table surface;

a shuffling machine for holding a set of cards consisting of a plurality of cards, each of the plurality of cards bearing indicia relevant to determining an outcome of a game of chance, the shuffling machine disposed adjacent the table surface;

a plurality of player positions disposed on the table surface for receipt of a respective player hand consisting of one or more cards as dealt by a live dealer;

a dealer position disposed on the table surface for receipt of a respective dealer hand consisting of one or more cards as dealt by a live dealer;

a RFID card reader for determining the indicia of each of the plurality of cards of the set of cards relevant to the outcome of the game of chance;

a computer configured to receive information about the outcome of the game of chance, including any wagers made on the outcome of the game of chance, the computer configured to automatically resolve any wagers without the need for use of any physical chips, the computer also configured to receive an input representative of the outcome of the game of chance;

a plurality of local electronic terminals associated with the table surface; each electronic terminal being associated with a respective one of the plurality of player positions;

a currency input device associated with each of the plurality of local terminals and configured to receive money from a player associated with the respective one of the plurality of player positions;

an input screen associated with each of the plurality of local terminals to allow a player to manually input wager on the outcome of the game of chance, the plurality of local terminals being in communication with the computer;

a plurality of wireless remote terminals in communication with the computer which are configured to receive an electronic wager on the outcome of the game of chance from a player located remotely from the table surface; and a table display associated with the table surface and configured to display the dealer hand and the outcome of the game of chance to allow the plurality of remote players to monitor the game of chance;

wherein the computer is configured to detect any electronic wagers input by the plurality of players at the plurality of local terminals and the plurality of wireless remote terminals and automatically resolve the electronic wagers based on the input representing the outcome of the game of chance.

2. The system of claim 1, wherein the RFID card reader is disposed adjacent the table surface.

3. The system of claim 1, wherein the RFID card reader is incorporated into the shuffling machine.

4. The system of claim 1, wherein each of the plurality of cards includes a mechanism that allows their indicia to be automatically read and communicated to the computer.

5. The system of claim 4, wherein each of the plurality of cards includes a unique RFID tag associated therewith.

6. The system of claim 5, wherein the RFID reader is disposed adjacent the table surface and configured to read the RFID tag associated with each of the plurality of cards to obtain the indicia information as they are removed from the shuffling machine.

7. The system of claim 1, wherein the game of chance has rules akin to one or more of the games of roulette, craps, blackjack or baccarat.

8. The system of claim 1, wherein the outcome of the game of chance is manually entered into the computer by the live dealer.

9. The system of claim 1, wherein the computer is configured to deal a remote player hand to each of the plurality or remote terminals.

10. A gaming system, comprising:

a table game surface for playing a game of chance;

a shuffling device associated with the table game surface for selecting one or more numbers relevant to determining an outcome of the game of chance;

a plurality of local player terminals associated with the table game surface, the plurality of local player terminals each associated with a player position and configured to receive wagers on the outcome of the game of chance, the plurality of local player terminals including a currency input device for receiving money from a player associated with the respective one of the plurality of player positions and an input screen to allow for electronic input of wagers on the outcome of the game of chance;

an RFID card reader associated with the table game surface and configured to read the identity of the one or more numbers selected from the shuffling device, the reader being in communication with a processor to transmit the identity of the one or more numbers selected from the shuffling for automatic determination of the outcome of the game of chance;

a processor associated with the table surface and configured to determine an outcome of the game of chance and resolve any wagers at the plurality of local player terminals electronically;

at least one remote player mobile terminal in communication with the processor, a remote player associated with the at least one remote player mobile terminal to allow the at least one remote player to place electronic wagers on the outcome of the game of chance despite the remote player not being located at a player position associated with the table surface;

a table display associated with the table surface and configured to display the dealer hand and the outcome of the game of chance to allow the at least one remote player to monitor the game of chance; and a dealer terminal associated with the dealer position and configured to receive information relevant to the outcome of the game of chance that is input from a live dealer, the dealer terminal further configured to automatically resolve any wagers at the plurality of local terminals and the at least one remote player mobile terminal.

11. The system of claim 10, wherein the shuffling device is a card shuffling device for holding a set of cards, with each card bearing indicia relevant to the outcome of the game of chance.

12. The system of claim 10, wherein the game of chance is selected from the games of roulette, craps, blackjack or baccarat.

13. The system of claim 11, wherein the RFID reader is disposed adjacent the table game surface.

14. The system of claim 11, wherein each of the cards in the set of cards includes a unique RFID tag associated therewith.

15. A gaming method comprising:

providing a table game surface for playing a first game of chance;

shuffling a first set of cards, with each of the cards bearing indicia relevant to an outcome of the first game of chance;

providing a live dealer to deal cards from the first set of cards to a plurality of player positions and a dealer position such that at least one player hand and a dealer hand consisting of a set of number of cards in accordance with rules of the first game of chance are formed;

providing an RFID card reader for obtaining information about the indicia of the cards relevant to the outcome of the first game of chance;

providing a currency input device at each of the player positions for receiving money directly from a player associated with the respective one of the plurality of player positions;

obtaining information about the indicia of the cards with the RFID card reader which comprise the at least one player hand and the dealer hand;

communicating the obtained information from the RFID card reader to a computer for determining an outcome of the first game of chance;

receiving electronic wagers from at least one of a plurality of local terminals disposed adjacent the table game surface;

receiving electronic wagers from at least one player associated with at least one remote terminal disposed away from the table game surface;

displaying on a screen associated with the table game surface information about the dealer hand and the outcome of the game of chance to allow the at least one remote player to monitor the first game of chance; and automatically resolving wagers from the plurality of local terminals and the at least one remote terminal based on the determined outcome of the game of chance electronically.

16. The gaming method of claim 15, further comprising:

providing a second table game surface for playing a second game of chance; and allowing the at least one remote terminal to place wagers on an outcome of the second game of chance.

17. The gaming method of claim 16, wherein the first game of chance and the second game of chance are different.

18. The method of claim 15, wherein the at least one remote terminal is a hand held terminal that is configured to communicate with the computer through wireless communication.

* * * * *